US009114623B2

(12) United States Patent
Kawajiri et al.

(10) Patent No.: US 9,114,623 B2
(45) Date of Patent: Aug. 25, 2015

(54) LIQUID CARTRIDGE AND IMAGE FORMING APPARATUS WITH SAME

(71) Applicants: Yasunobu Kawajiri, Kanagawa (JP); Atsushi Miwa, Tokyo (JP); Shotaro Takeuchi, Kanagawa (JP); Masashi Ohnishi, Kanagawa (JP); Ikoh Soh, Kanagawa (JP); Tadashi Hayakawa, Kanagawa (JP)

(72) Inventors: Yasunobu Kawajiri, Kanagawa (JP); Atsushi Miwa, Tokyo (JP); Shotaro Takeuchi, Kanagawa (JP); Masashi Ohnishi, Kanagawa (JP); Ikoh Soh, Kanagawa (JP); Tadashi Hayakawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 8 days.

(21) Appl. No.: 14/024,800

(22) Filed: Sep. 12, 2013

(65) Prior Publication Data

US 2014/0071211 A1 Mar. 13, 2014

(30) Foreign Application Priority Data

Sep. 13, 2012 (JP) ..... 2012-201554

(51) Int. Cl.
*B41J 2/175* (2006.01)

(52) U.S. Cl.
CPC ..... *B41J 2/17546* (2013.01); *B41J 2/1752* (2013.01); *B41J 2/17523* (2013.01); *B41J 2/17553* (2013.01); *B41J 2002/17516* (2013.01)

(58) Field of Classification Search
USPC ..... 347/85–87, 89, 95, 63, 65
See application file for complete search history.

(56) References Cited

U.S. PATENT DOCUMENTS

| | | | | |
|---|---|---|---|---|
| 5,992,975 | A * | 11/1999 | Gasvoda et al. | 347/85 |
| 7,080,898 | B2 * | 7/2006 | Katayama | 347/86 |
| 7,226,154 | B2 * | 6/2007 | Seino et al. | 347/86 |
| 7,806,523 | B2 * | 10/2010 | Seino et al. | 347/86 |
| 7,874,659 | B2 * | 1/2011 | Silverbrook et al. | 347/86 |
| 2009/0256892 | A1 | 10/2009 | Takeuchi | |
| 2010/0171799 | A1 | 7/2010 | Takeuchi et al. | |
| 2010/0225716 | A1 | 9/2010 | Hayakawa et al. | |
| 2010/0232827 | A1 | 9/2010 | Tokuno et al. | |
| 2010/0277555 | A1 | 11/2010 | Katoh et al. | |
| 2010/0295908 | A1 | 11/2010 | Katoh et al. | |
| 2011/0025789 | A1 | 2/2011 | Kuwata et al. | |
| 2011/0050819 | A1 | 3/2011 | Bannai et al. | |
| 2011/0057997 | A1 | 3/2011 | Takeuchi | |
| 2011/0063382 | A1 | 3/2011 | Kuwata et al. | |
| 2013/0010038 | A1 | 1/2013 | Hayakawa et al. | |

FOREIGN PATENT DOCUMENTS

| | | |
|---|---|---|
| JP | 2002-307711 | 10/2002 |
| JP | 2012-226289 | 11/2012 |
| WO | WO2004/037541 A1 | 5/2004 |

* cited by examiner

*Primary Examiner* — Kristal Feggins
(74) *Attorney, Agent, or Firm* — Cooper & Dunham LLP

(57) ABSTRACT

A liquid cartridge detachably attached to an image forming apparatus to supply liquid to image forming apparatus. The liquid cartridge includes a cartridge case composed of first and second sub cases. At least one of the first and second sub cases includes an open space to accommodate an information storage device in the open space. The first and second sub cases are combined to close the open space and hold the information storage device so as to prevent removal of the information storage device accommodated in the open space therefrom.

20 Claims, 18 Drawing Sheets

LIQUID CARTRIDGE AND IMAGE FORMING APPARATUS WITH SAME

CROSS-REFERENCE TO RELATED APPLICATION

This patent application is based on and claims priority pursuant to 35 U.S.C. §119 to Japanese Patent Application No. 2012-201554, filed on Sep. 13, 2012 in the Japan Patent Office, the entire disclosure of which is hereby incorporated by reference herein.

BACKGROUND

1. Technical Field

This invention relates to a liquid cartridge storing a liquid such as ink, etc., and an image forming apparatus with the same.

2. Related Art

As an image forming apparatus, such as a printer, a facsimile machine, a copier, etc., an ink-jet system that utilizes a printing head that dispenses liquid drops or the like is known. In such an image forming apparatus, the printing head supplies ink droplets onto a printing medium (hereinafter also simply "sheet") conveyed to a printing section of the apparatus and forms an image on the sheet.

These image forming apparatuses are of two types. One is a serial-type image forming apparatus that forms images by ejecting liquid drops onto a sheet while moving a printing head in a main scanning direction. The other is a line-type image forming apparatus that forms an image by ejecting liquid drops without moving the printing head.

In such an image forming apparatus (hereinafter, simply referred to as an inkjet printer or a printer), a replaceable liquid cartridge (hereinafter, sometimes referred to as an ink cartridge) storing liquid to be supplied to the printing head is installed in the printer. A storage cell (hereinafter, sometimes referred to as an ID (identification)-chip) is provided in the ink cartridge to convey information such as the amount of ink remaining in the ink cartridge, etc.

Accordingly, when the ink cartridge is installed in the printer, a terminal provided in the ID chip and that provided in the printer need to contact each other to establish an electrically conductive condition to execute communications therebetween. However, when the terminals are erroneously positioned, and accordingly defective contact occurs resulting therefrom, the printer and the ID chip become unable to communicate with each other.

To solve such a problem, Japanese Patent No. 4843112 (JP-4843112-B) discloses a configuration (FIG. 54 or the like) in which an ID chip is movably held in parallel to a mounting face of a cartridge and is prevented from detaching from the cartridge by a cover over the ID chip, for example.

However, with the configuration of JP-4843112-B, since the cover for the ID chip and a case-securing member are needed, the number of parts increases and so does the manufacturing cost.

SUMMARY

Accordingly, one aspect of the present invention provides a novel liquid cartridge detachably attached to an image forming apparatus to supply liquid thereto. The liquid cartridge includes a cartridge case composed of first and second sub cases. At least one of the first and second sub cases includes an open space to accommodate an information storage device in the open space. The first and second sub cases are combined to close the open space and hold the information storage device so as to prevent removal of the information storage device accommodated in the open space therefrom.

Another aspect of the present invention provides a novel liquid cartridge detachably attached to an image forming apparatus to supply liquid thereto. The liquid cartridge includes a cartridge case composed of first and second sub cases and an information storage device holder provided in the cartridge case to hold an information storage device. At least one of the first and second sub cases includes an open space to accommodate the information storage device therein. The open space is closed to prevent removal of the information storage device inserted thereinto when the first and second sub cases are combined.

Yet another aspect of the present invention provides a novel liquid cartridge detachably attached to an image forming apparatus to supply liquid thereto. The liquid cartridge includes a cartridge case composed of first and second sub cases and an information storage device holder attached to the cartridge case to hold an information storage device. The information storage device holder fixes the first and second sub cases.

Yet another aspect of the present invention provides a novel image forming apparatus that includes a printing system to print an image on a sheet using liquid and a liquid cartridge detachably attached to the image forming apparatus to store the liquid. The liquid cartridge includes a cartridge case composed of first and second sub cases and an information storage device holder provided in the cartridge case to hold an information storage device. At least one of the first and second sub cases includes an open space to accommodate the information storage device therein. The open space is closed to prevent removal of the information storage device inserted thereinto when the first and second sub cases are combined.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
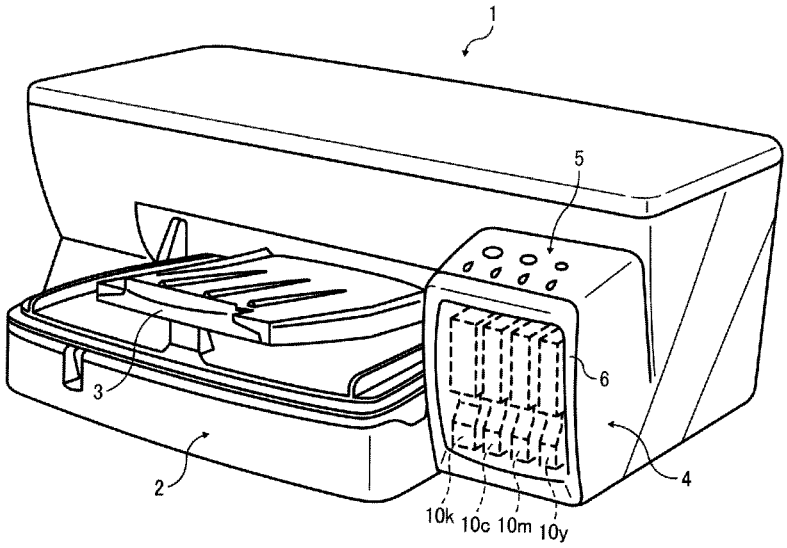
FIG. 1 is a perspective view illustrating an appearance of an exemplary inkjet printer of an image forming apparatus according to one embodiment of the present invention.

Referring now to the drawings, wherein like reference numerals designate identical or corresponding parts throughout the several views thereof and in particular to FIG. 1, appearance of an exemplary inkjet printer of an image forming apparatus is described according to one embodiment of the present invention. This inkjet printer includes a printer body 1 second (fourth), a sheet feeding tray 2 mounted on the printer body 1 to load multiple sheets thereon, and a sheet exit tray 3 removably installed in the printer body 1 to stock plural sheets, on to which images are respectively printed (or formed). Further, at one end (beside a sheet feeding exit tray) on a front surface of the printer body 1, a cartridge loading section 4 is provided to load an ink cartridge 10 serving as a printing liquid cartridge. An operation/display section 5 composed of multiple operation buttons and indicators or the like is provided above the cartridge loading section 4.

In the cartridge loading section 4, multiple ink cartridge 10*k*, 10*c*, 10*m*, and 10*y* (hereinafter, referred to as a color ink cartridge 10 when color does not matter) storing respective printing liquid (i.e., ink) as colorants having a different color from each other, such as black (K) ink, cyan (C) ink, magenta (M) ink, and yellow (Y) ink, are enabled to be inserted and loaded from a front side of the printer body 1 toward the rear side of the printer body 1. The front cover (i.e., a cartridge cover) 6 is provided on the front side of the cartridge loading section 4 to be able to open and close when the ink cartridge 10 is attached and detached.

Figure 2:
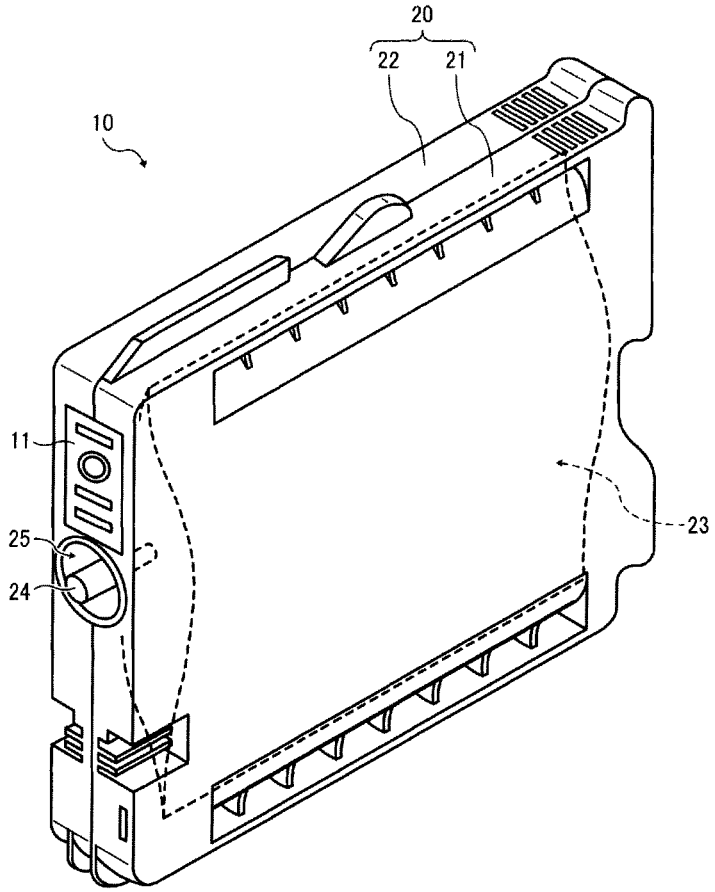
FIG. 2 is a perspective view illustrating an exemplary ink cartridge according to one embodiment of the present invention.
Figure 3:
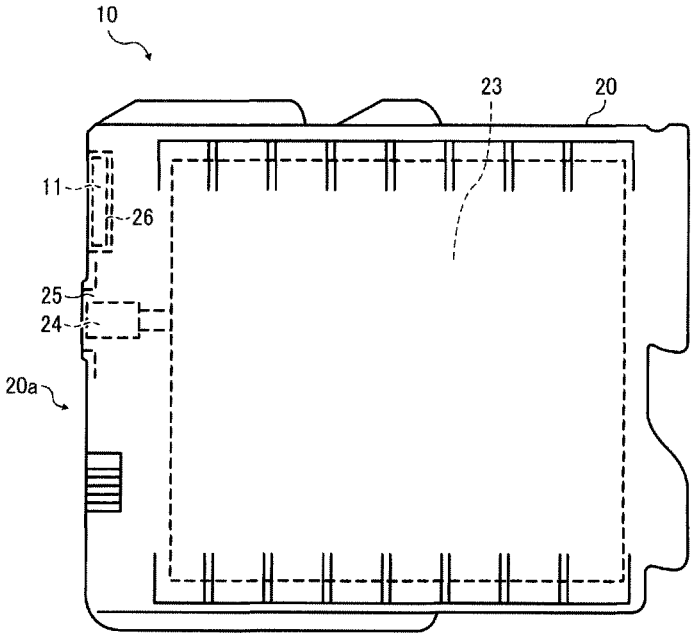
FIG. 3 is a side view illustrating the ink cartridge according to one embodiment of the present invention.

Since a mechanical configuration of the inkjet printer according to this embodiment is almost the same as that of a known inkjet printing apparatus and a redundant description thereof is thus omitted. FIG. 2 is a perspective view of the ink cartridge 10 taken from a backside of the ink cartridge 10 (i.e., a rear side of the ink cartridge 10 when it is installed in the printer body 1). FIG. 3 is a side view illustrating the ink cartridge 10. Here, although the present invention is described by limiting a liquid storage member to a cartridge for supplying ink, it is not limited thereto and can employ any other device that stores things other than liquid, or those intended to collect ink not used in printing or the like as well.

The ink cartridge 10 includes the cartridge case (i.e., a housing) 20 and an ink bag 23 as a printing liquid storage device that stores printing liquid therein. The cartridge case 20 is composed of first and second first and second sub cases 21 and 22, partitioned into two to be able to assembled and/or disassembled. Further, the cartridge case 20 includes an opening 25 formed at its portion corresponding to an ink supplying port 24 of the ink bag 23 installed therein.

When the ink cartridge 10 is mounted onto the cartridge loading section 4, a hollow needle provided on the backside of the cartridge mounting section 4 pierces a supplying port 24 of the ink bag 23, so that an interior of the ink bag 23 and a supply pump unit provided in the printer body 1 are communicated with each other, thereby capable of supplying ink stored in the ink bag 23 toward the printer body 1.

Further, a non-volatile rewritable memory 11 such as EEPROM (Electrically Erasable Programmable Read-Only Memory), etc., (hereinafter, referred to as an ID chip serving as an information storage device) is installed at an upper portion of the backside of the ink cartridge 10. In the ID chip 11, information related to the ink cartridge 10, such as, for example, color of ink, type of ink, expiration date, ID number, authenticity, number of refills, amount of ink remaining, etc., are stored. Further, when the ink cartridge 10 is mounted onto the cartridge loading section 4, it is electrically connected to an electrical terminal provided in the printer body 1, so that information stored in the ID chip 11 becomes readable for the printer body 1. Further, the ID chip 11 becomes writable from the printer body 1.

The ID chip 11 is not secured to the cartridge case 20, and is movably held in a holder 26 provided in the cartridge case 20 in parallel to a wall surface 20*a* of the cartridge case 20. Specifically, the ID chip 11 can move in a plane parallel to the wall surface 20*a* of the cartridge case 20 both vertically and horizontally or diagonally. With the later described configuration of the cartridge case, the ID chip 11 is prevented from falling out from the holder 26.

Figure 4:
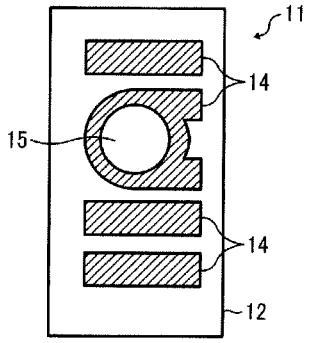
FIG. 4 is a plan view illustrating an exemplary ID chip as an information storage device according to one embodiment of the present invention.
Figure 5:
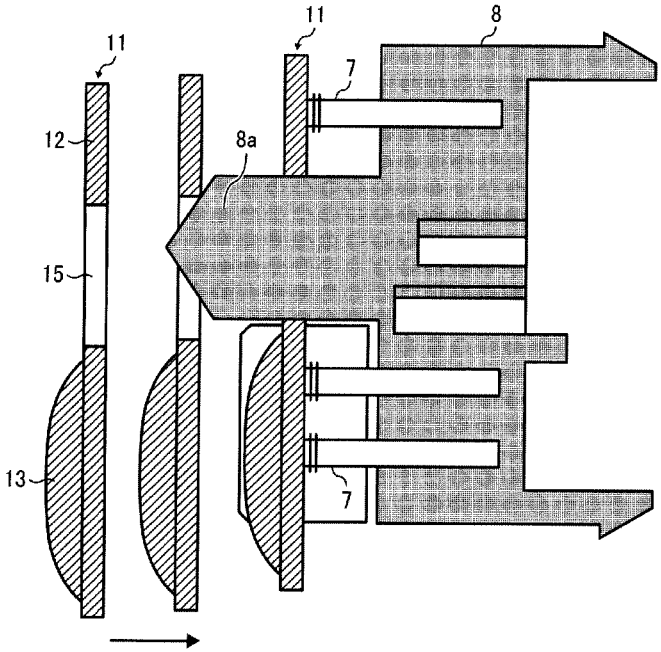
FIG. 5 is a view illustrating one aspect of the ID chip when it is connected to an electrode terminal provided in the inkjet printer according to one embodiment of the present invention.

FIG. 4 is a plan view illustrating the ID chip 11. As shown there, the ID chip 11 is provided with multiple contacts 14 on an outside surface of a circuit board (i.e., an outer surface when the ID chip 11 is attached to the ink cartridge 10). On the inner side of the circuit board 12 not shown in this drawing, there is provided a memory unit 13 as shown in FIG. 5. Further, there is provided a fitted section 15 in the baseboard 12, into which the later described fitting protrusion formed in a connector provided in the printer body fits. Although a circular hole is formed as the fitted section 15 in this example, the shape of the fitted section and the fitting projection of the printer body connector can be varied as needed. For example, a cutout shape, such as a square hole, a slit, etc., can be employed as the shape of the fitted section or the fitting projection of the printer body connector.

FIG. 5 is a view illustrating one aspect of the ID chip when it is connected to an electrode terminal provided in the printer body 1. Here, in FIG. 5, the printer body 1 is located on the right side of the drawing while the ink cartridge 10 is located on the left side of the drawing.

When the ink cartridge 10 is set to the cartridge loading section 4 (see, FIG. 1), the ID chip 11 held by the cartridge case 20 (not shown in FIG. 5) moves toward and closer to the connector 8 of the printer body 1 as shown by arrow in FIG. 5. As described earlier, the connector 8 includes the fitting projection 80*a* capable of fitting into the fitted hole 15 formed in the ID chip 11. Thus, the fitted hole 15 of the ID chip 11 is fitted by the connector fitting projection 8*a* when the ID chip 11 is guided by a slope formed at a tip of the fitting projection 8*a* and moves in parallel to the wall surface 20A of the cartridge case. With this, the ID chip 11 is positioned at a prescribed location regarding the printer body 1.

The connector 8 of the printer body 1 includes an electrode terminal 7. Thus, when the fitting projection 8*a* of the connector 8 fits into the fitted hole 15 of the ID chip 11, the contact point 14 of the ID chip 11 (see, FIG. 4) contacts the electrode terminal 7 provided in the printer body 1 so that the ID chip 11 is electrically connected with the printer body 1 thereby establishing a conductive state.

Figure 6:
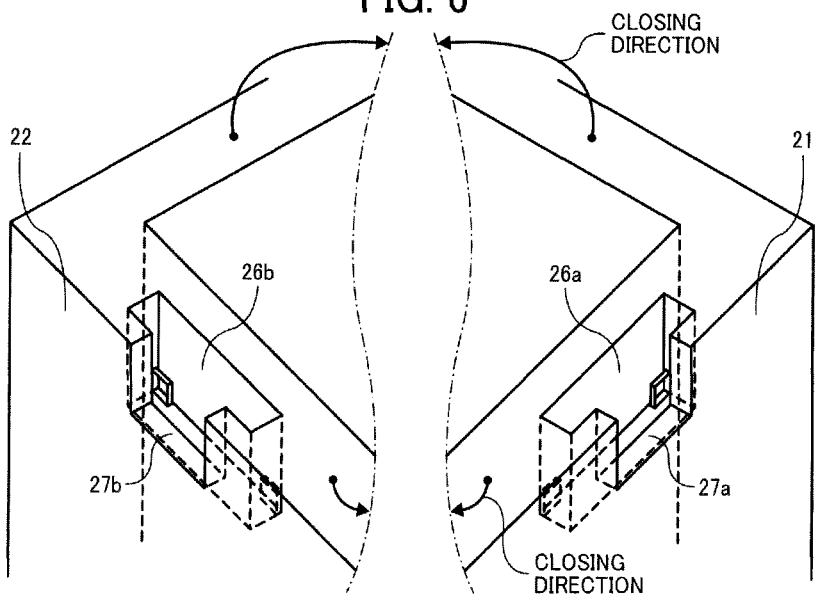
FIG. 6 is a perspective view partially illustrating an exemplary ID chip holder provided in a cartridge case according to one embodiment of the present invention.

FIG. 6 is a perspective view partially illustrating an ID chip holder provided in the cartridge case 20. As shown in the drawing, the first and second sub cases 21 and 22 collectively constitutes the cartridge case 20 while having spaces 26*a* and 26*b* formed therein, respectively. These spaces 26*a* and 26*b* in the both cases 21 and 22 have symmetrical shapes regarding a joint surface of the both cases 21 and 22, and accordingly provide an ID chip holder 26 (see, FIG. 3) when these cases 21 and 22 are connected to (or combined with) each other.

In the wall surfaces (i.e., the wall surfaces of backsides) of the first and second first and second sub cases 21 and 22, there are formed cutouts 27*a* and 27*b* communicating with the spaces 26*a* and 26*b*, respectively. Thus, by connecting (i.e., combining) the both cases 27*a* and 27*b* to or with each other, these cutouts 27*a* and 27*b* constitute an opening 27 as shown in FIG. 7.

Hence, when the cartridge a case 20 is divided into the first and second sub cases 21 and 22, the above-described spaces 26*a* and 26*b* are open to accept insertion of the ID chip 11. However, when the two sub cases gland 22 are connected to (or combined with) each other, the ID chip 11 may not be inserted into a space currently changing to an ID chip holder 26 from the outside. Further, when the ID chip is inserted into the space currently serving as the ID chip holder 26, i.e., the ID chip 11 is held by the ID chip holder 26, the ID chip 11 may not be detached to an outside therefrom. Specifically, when these two sub cases 21 and 22 are connected to (combined with) each other, the ID chip 11 held by the ID chip holder 26 is prevented from dropping out.

Figure 7:
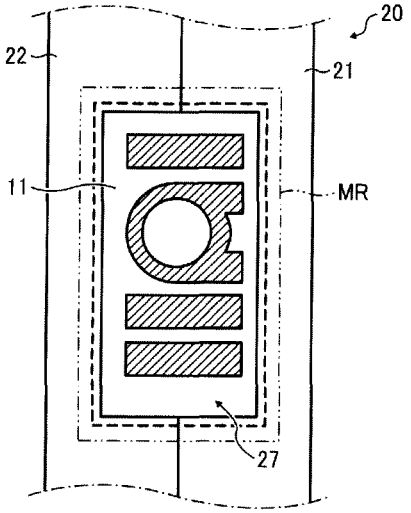
FIG. 7 is a diagram schematically illustrating a movable range of the ID chip according to one embodiment of the present invention.

FIG. 7 is a view illustrating a condition of the cartridge case 20 taken from the backside of the cartridge case 20 when the ID chip 11 is held by the ID chip holder 26 formed by connecting (combining) the first and second sub cases 21 and 22 with each other. As shown there, the opening 27 allows the interior space of the ID chip holder 26 to communicate with an outside of the cartridge case 20. Thus, a terminal 7 provided in the printer body 1 is connected to a contact 14 provided in the ID chip 11 held in the ID chip holder 26 through the opening 27.

A two-dashed line in FIG. 7 shows an ID chip movable range in which the ID chip 11 can move within the ID chip holder 26. A size of the opening 27 formed by the first and second first and second sub cases 21 and 22 is less than that of the ID chip 1. With this, the ID chip 11 is prevented from dropping out from the opening 27 by (the cartridge case by itself).

Hence, according to the ink cartridge 10 of this embodiment, the ID chip holder 26 and the opening 27 are composed of both the first and second first and second sub cases 21 and 22 collectively constituting cartridge case 20. Further, the cutouts 27*a* and 27*b* serving as the space of the ID chip holder 26 and the opening 27 are included both in the first and second sub cases 21 and 22. However, the ID chip holder 26 and the opening 27 may be provided in one of the first and second first and second sub cases 21 and 22. Specifically, the cutouts 27*a* and 27*b* providing both the space of the ID chip holder 26 and the opening 27 can be omitted in the other one of the first and second sub cases 21 and 22.

Here, when the cutouts 27*a* and 27*b* serving as the space of the ID chip holder 26 and the opening 27 are included both in the first and second sub cases, the symmetrical cutouts 27*a* and 27*b* are provided in both the first and second sub cases 21 and 22, respectively, as shown in FIG. 6. However, the cutouts 27*a* and 27*b* can be asymmetrically provided in both the first and second sub cases 21 and 22, respectively. For example, sizes of the space and cutout 27*a* of the first case 21 can be greater than that 27*b* of the second case 22 to form the ID chip holder 26 and the opening 27 when both of the cases 21 and 22 are combined.

Figure 8:
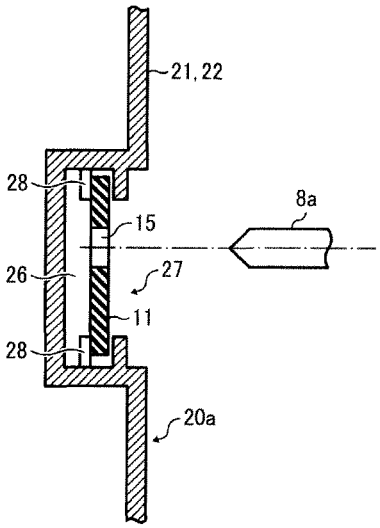
FIG. 8 is a cross-sectional view illustrating one aspect of the cartridge case shown in FIG. 7 taken along a center of the cartridge case according to one embodiment of the present invention.

FIG. 8 is a cross-sectional view illustrating the cartridge case 20 shown in FIG. 7 taken along a center of the cartridge case 20 (i.e., a widthwise center of the cartridge case in FIG. 7). Since the opening 27 is smaller than the ID chip 11, the ID chip 11 is prevented from dropping out by the wall surface of the cartridge case 50. Moreover, a pair of stopping ribs 28 and 28 is provided in the ID chip holder 26 to stop movement of the ID chip 11 toward the backside (i.e., to the left in FIG. 8) of the ID chip case in this embodiment. Optionally, by adjusting a depth of the ID chip holder 26 to be a reasonable size, the pair of stopping ribs 28 and 28 can be omitted. Hence, the ID chip 11 held in the ID chip holder 26 can move in parallel to the wall surface of the cartridge case 20. Thus, by inserting a protrusion 8*a* formed in the connector 8 provided in the printer body 1 into the fitted hole 15 of the ID chip 11, the body side connector 8 and the ID chip 11 can be relatively positioned.

Figure 9:
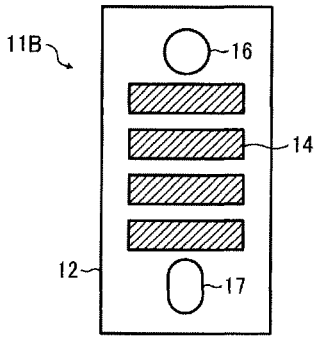
FIG. 9 is a plan view illustrating another example of the ID chip according to one embodiment of the present invention.

Now, an ink cartridge of a second embodiment is described with reference to FIGS. 9-11, wherein like reference numerals designate identical or corresponding parts throughout the several views thereof and in particular to FIG. 9, an ID chip 11B of the second embodiment is provided with multiple contact points 14 on an outer surface of the circuit board 12 (i.e., on an outside surface when the ID chip 11B is installed in the ink cartridge). In the inner surface of the circuit board 12 invisible in this diagram, a memory unit 13 is provided as in the previously described ID chip 11. Further, two fitted holes 16 and 17 to be fitted respectively by two pieces of the fitting projections 18*a* and 18*a* provided in the printer body side connector are provided in the circuit board 12. Here, the fitted hole 16 has a round shape while the fitted hole 17 has an oval shape.

The ID chip 11B is held by the ID chip holder 26 provided in the cartridge case 20 as the previously described ID chip 11. Specifically, the ID chip 11B can move in parallel to the wall surface 20*a* of the cartridge case 20 while it is prevented from dropping out by the cartridge case itself therefrom.

Figure 10:
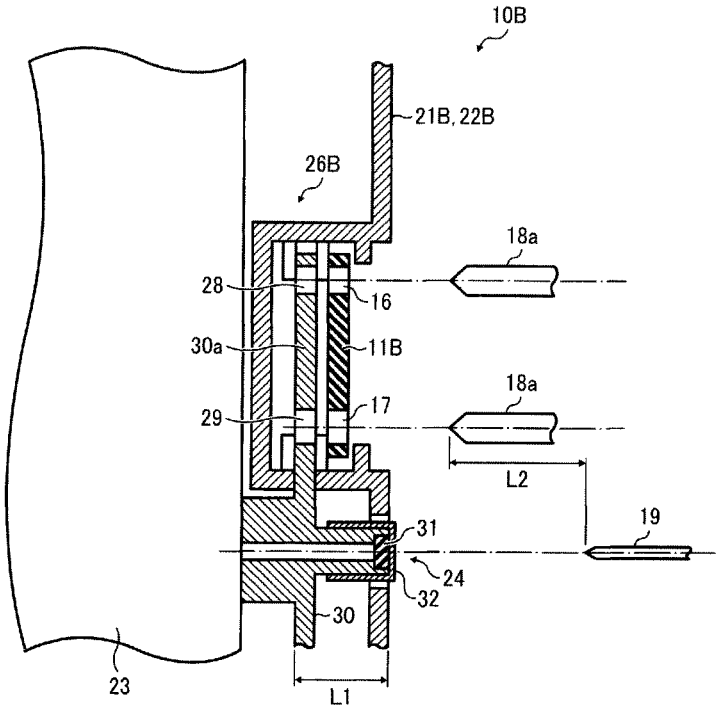
FIG. 10 is a cross-sectional view illustrating an aspect near an ID chip holder provided in an ink cartridge according to a second embodiment of the present invention.
Figure 11:
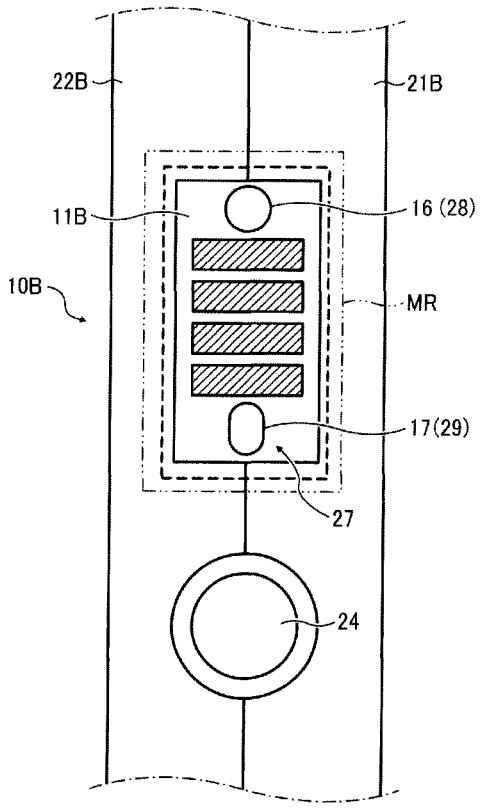
FIG. 11 is a diagram schematically illustrating a movable range of the ID chip according to a second embodiment of the present invention.

FIG. 10 is a cross-sectional view illustrating surroundings of an ID chip holder 26 provided in an ink cartridge according to the second embodiment of the present invention. As shown there, a supplying port unit 30 either constitutes or holds an ink supplying port 24 is welded to an ink bag 23. The ink supplying port 24 is provided with a packing 31 pressed by a cover 32 to avoid leakage of the ink therefrom. Thus, by breaking through the packing 31 with an ink supplying pipe 19 provided in the printer body 1, an ink flow path toward a printing head is established connecting to the ink cartridge. Instead of the above-described packing 31 used in this embodiment, a prescribed valve such as a ball valve, etc., may be used to avoid the leakage of ink from the ink supplying port 24.

Further, an extended member 30*a* is arranged in the supplying port unit 30 to enter the ID chip holder 26B in parallel with the ID chip 11B. A pair of fitted holes 28 and 29 having sizes matching with two fitted holes 16 and 17 formed in the ID chip 11B are also formed in the extended member 30*a* at positions corresponding thereto, respectively.

When the ink cartridge 10B of the second embodiment is attached to the cartridge loading section 4 (seed, FIG. 1), two pieces of fitting projections 18*a* and 18*a* provided in a connector (not shown) attached to the printer body side 1 are fitted into fitted holes 16 and 17 of the ID chip 11*b* and fitted holes 28 and 29 of the supplying port unit 30, respectively. With this, the printer body side connector 18 and the ID chip 11B are relatively mutually positioned regarding to each other. At the same time, an ink-supplying pipe 19 provided in the printer body 1 and the ink supplying port 24 are also relatively mutually positioned.

Here, since a time when the fitting protrusions 18*a* and 18*a* are inserted into the fitted holes 16 and 17 of the ID chip 11B, and that when these are inserted into the fitted holes 28 and 29 of the supplying port unit 30, respectively, can be substantially the same, specifically, the time difference can be ignored, positioning of both the ID chip 11B and the ink supplying port 24 (i.e., the supplying port unit 30) are executed substantially at the same time.

Further, a positional relation (i.e., a distance L1) between the extended member 30*a* and the packing 31 in a back and forth direction of the ink cartridge (i.e., in a horizontal direction in FIG. 10), and a positional relation (i.e., a distance L2) between the fitting projection 18*a* of the connector of the printer body 1 and the ink supplying pipe 19 are designed to meet the following inequality, $L1<L2$. Accordingly, even when tips of the fitting projections 18*a* fit into the fitted holes 16 and 17 and 28 and 29, respectively, and accordingly the ID chip 11B and the ink supplying port 24 are positioned, the ink supplying pipe 19 does not reach (the packing 31 of) the ink supplying port 24. Specifically, the system is configured such that the ink supplying pipe 19 breaks through the packing 31 for the first time when the fitting projections 18*a* and 18*a* further enter the fitted holes 16 and 17 and 28 and 29 from the above-described position in which the ink supplying pipe 19 does not reach (the packing 31 of) the ink supplying port 24.

In this way, by positioning the ink supplying port 24 before the ink supplying pipe 19 contacts the packing 31, the ink-supplying pipe 19 becomes easily inserted into the ink supplying port 24. Specifically, with this, the ink-supplying pipe 19 can be precisely inserted into the ink supplying port 24.

Figure 12:
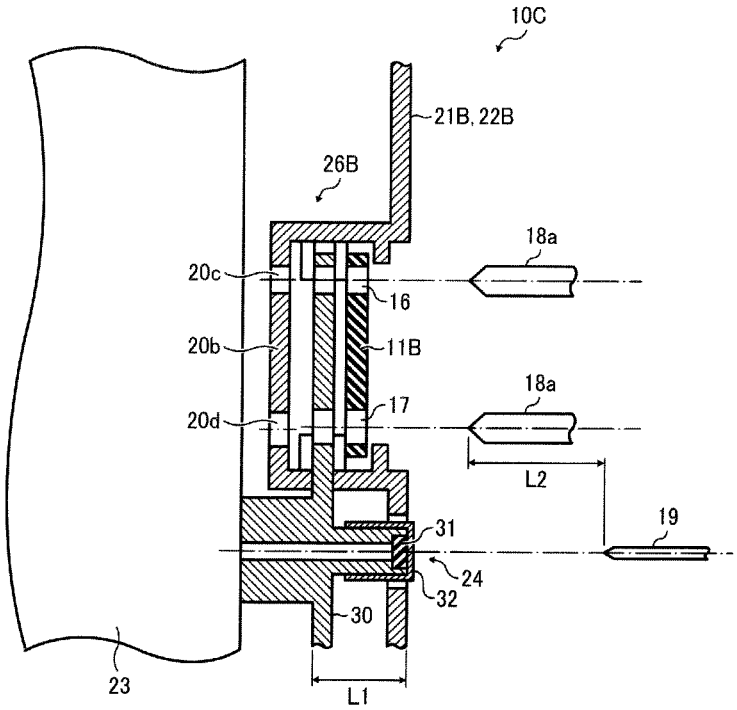
FIG. 12 is a cross-sectional view illustrating an aspect near an exemplary ID chip holder provided in an ink cartridge according to a third embodiment of the present invention.

FIG. 12 is a cross-sectional view illustrating surroundings of an ID chip holder 26B provided in an ink cartridge according to a third embodiment of the present invention. Since configuration and operation of the ink cartridge 10C of the third embodiment is almost the same as that of the ink cartridge 10B of the second embodiment, only different configuration and operation is described, wherein like reference numerals designate identical or corresponding parts.

As shown in FIG. 12, in the bottom 20*b* of the ID chip holder 26B formed by the first and second sub cases 21B and 22B again, two fitted holes 20*c* and 20*d* are provided as fitted sections, into which two fitting projections 18*a* and 18*a* provided in a connector disposed in the printer body 1 fit, respectively. Location and magnitude of the fitted holes 20*c* and 20*d* correspond to those of the fitted holes 16, 17, 28, and 29 provided in the extended section 30*a* and the ID chip 11B. The extended section 30*a* and the fitted holes 28 and 29 are substantially the same as those already described with reference to FIG. 10.

Further, in the ink cartridge 10C according to the third embodiment, when these two fitting projections 18*a* and 18*a* fit into these two fitted holes 20*c* and 20*d* provided in the bottom 20*b* of the ID chip holder 26B, respectively, the cartridge body (i.e., the cartridge case 20 composed of the first and second sub cases 21B and 22B) is positioned regarding the printer body 1. Specifically, by attaching the ink cartridge 10C to the cartridge loading section 4 (see, FIG. 1) in this embodiment, the cartridge body can be positioned at the same time when the ID chip 11B and the ink supplying port 24 are positioned.

In the ink cartridge employed in each of the above described various embodiments, since the ID chip is held by the cartridge case itself without using a cover as different parts to prevent it from dropping out from the cartridge, manufacturing labor is likely eliminated and the number of parts and accordingly the manufacturing cost can be reduced.

When spaces in the first and the second cases (collectively) serving as an ID chip holder 26 are symmetrically shaped, the ID chip can be selectively inserted into the both spaces of the first and the second cases thereby capable of easing assembly when the ink cartridge is assembled.

Now, an ink cartridge according to a fourth embodiment is herein below described with reference to FIG. 13 which illustrates the ink cartridge 40 (as employed in the first embodiment) taken from the backside of the ink cartridge 40 (i.e., a rear side of the ink cartridge 40 when it is installed in the printer body 1) and applicable drawings. In short, the ink cartridge of this fourth embodiment holds an ID chip in a cartridge case using an ID chip holder.

Figure 13:
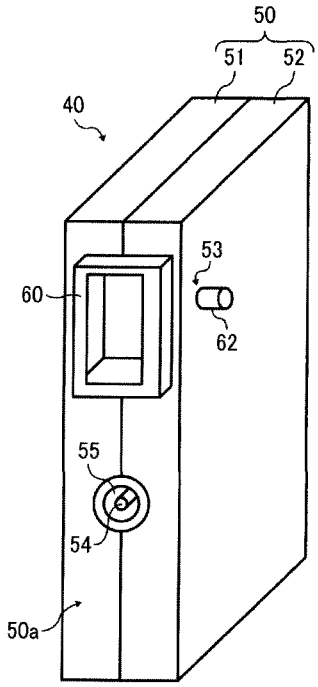
FIG. 13 is a perspective view illustrating an ink cartridge according to the second embodiment of the present invention.

As shown in FIG. 13, the ink cartridge 40 of the fourth embodiment is composed of a cartridge case (a housing) 50 that accommodates an ink bag (not shown) as a printing liquid storing device storing ink such as a printing liquid, etc. The cartridge case 50 is composed of first and second sub cases 51 and 52 divided into two to enable disassembling and assembling of those. Further, an opening 55 is formed in the cartridge case 50 at a position corresponding to an ink supplying port 54 included in the ink bag installed in the cartridge case 50.

Hence, when the ink cartridge 40 is mounted onto the cartridge loading section 4 (see, FIG. 1), a hollow needle provided in a backside of the cartridge mounting section 4 penetrates the ink bag, so that an interior of the ink bag and a supply pump provided in the printer body 1 are communicated to each other. Thus, the ink stored in the ink bag is ready to be supplied toward the printer body 1.

Further, an ID chip composed of a rewritable non-volatile memory, such as EEPROM, etc., is mounted and held on an upper portion in a backside 50*a* of the ink cartridge 40 via an ID chip-accommodating container 60. The ID chip is not shown in FIG. 13, but can employ one of the ID chip 11 and 11B as described earlier with reference to FIGS. 4 and 9, respectively.

Hence, when the ink cartridge 40 is mounted onto the cartridge loading section 4, it is electrically connected to an electric terminal provided in the printer body 1, and accordingly information stored in the ID chip 11 (or 11B) becomes ready to be read by the printer body 1. By contrast, the printer body 1 becomes ready to write information into the ID chip 11 (or 11B) as well.

Figure 14A:
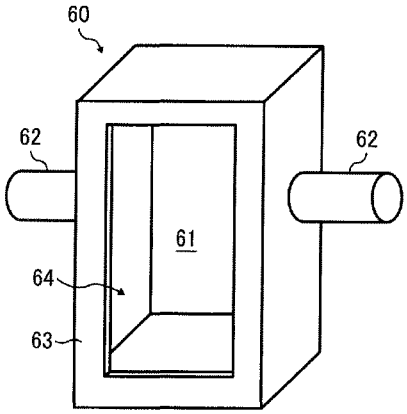
FIG. 14A is a perspective view illustrating an ID chip accommodating container according to one embodiment of the present invention.
Figure 14B:
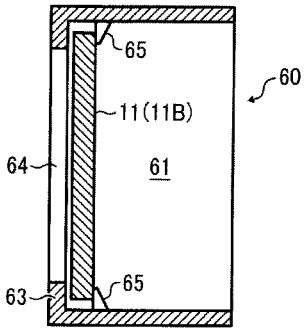
FIG. 14B is a cross-sectional view illustrating the ID chip accommodating container according to one embodiment of the present invention.

FIGS. 14A and 14B are perspective and cross-sectional views illustrating the same ID chip accommodating containers 60, respectively. As shown in the drawings, an ID chip holder 61 is prepared in the ID chip-accommodating container 60. At an outer end of the ID chip holder 61, an exterior wall 63 is provided. In the exterior wall 63, there is provided an opening 64. Further, from both sides of the ID chip-accommodating container 60, a pair of fixing sections and 62 symmetrically protrudes to fix the ID chip-accommodating container 60 to the cartridge case 50, respectively.

As shown in the cross-sectional view of FIG. 14B, at both ceiling and bottom surfaces of the ID chip holder 61, there are provided convex ribs 65 and 65, respectively. The ID chip 11 (or 11B) is sandwiched by in between the ribs 65 and 65 and the exterior wall 63, so that the ID chip 11 (or 11B) can be movably held in the ID chip holder 61 in parallel to a wall surface 50*a* of the cartridge case 50. Specifically, the ID chip 11 (or 11B) can move is that horizontally, vertically, and diagonally on a plane parallel to a wall surface (i.e., the backside 50*a* of the ink cartridge 40). Further, the opening 64 provided in the exterior wall 63 is smaller than the ID chip 11 (or 11B) again. Accordingly, the exterior wall 63 can prevent the ID chip 11 (or 11B) from dropping out.

Hence, when the cartridge case 50 is assembled, the first and second sub cases 51 and 52 sandwiches the ID chip accommodating container 60 therebetween, and accept the fixing sections 62 to penetrate through and protrude from the holes 53 provided in the both first and second sub cases 51 and 52, respectively. Then, these first and second sub cases 51 and 52 and the fixing section 62 are either welded or glued. Thus, the ID chip-accommodating container 60 and these first and second sub cases 51 and 52 can be fixed without using a screw. Further, since the ID chip accommodating container 60 is installed in the cartridge case 50 composed of the first and second sub cases 51 and 52, the ID chip 11 (or 11B) can be movably held in the cartridge case 50 (i.e., the ink cartridge 40) via the ID chip accommodating container 60 while preventing dropping out therefrom.

Although the ink cartridge 40 of this embodiment employs the ID chip accommodating container 60 to hold the ID chip 11 (or 11B), since the ID chip accommodating container 60 fixes the first and second sub cases 51 and 52, fixing parts, such as screws, etc., can be omitted to assemble the first and second sub cases 51 and 52, thereby capable of reducing the manufacturing cost.

Figure 15:
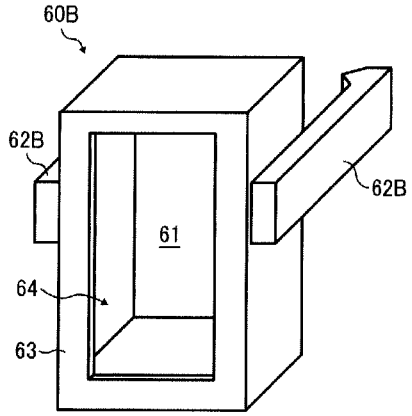
FIG. 15 is a perspective view illustrating an ID chip-accommodating container used in the second embodiment according to the present invention.

FIG. 15 is a perspective view illustrating an ID chip-accommodating container used in the fifth embodiment according to the present invention. As shown there, an ID chip accommodating container 60B shown in the drawing has almost the same configuration as the ID chip accommodating container 60 of FIG. 14 except for a pair of fixing sections 62B and 62B provided at its both sides to be used as snap-fits. Further, the cartridge case 50 has almost the same configuration as that of the ink cartridge 40 of FIG. 13 except that a pair of holes 53 formed in the first and second sub cases 51 and 52, respectively, have prescribed shapes corresponding to the snap-fit fixing sections 62B as different from those having the circular shapes in FIG. 13.

According to this fifth embodiment, since the snap-fit holder 62B as a fixing device of securing the first and second sub cases 51 and 52 is utilized, and accordingly the first and second sub cases 51 and 52 are not rigidly secured to each other unlike the first example, the ink cartridge can be easily decomposed when it is recycled or reused, thereby capable of contributing to manufacturing cost reduction.

Figure 16:
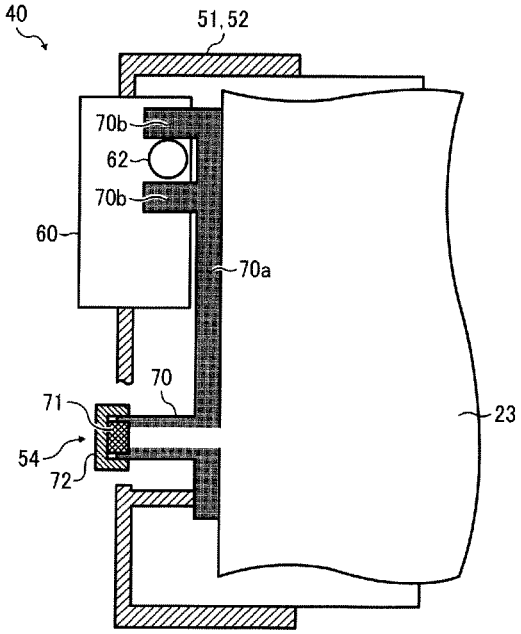
FIG. 16 is a cross-sectional view illustrating a section near a backside of the ink cartridge according to the third embodiment of the present invention.
Figure 17:
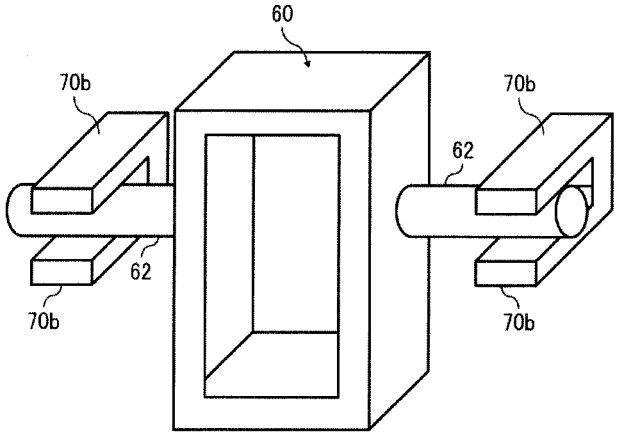
FIG. 17 is a perspective view illustrating one aspect when a fitting section provided in the ink cartridge fits into the ID chip accommodating container according to one embodiment of the present invention.

Now, an ID chip accommodating container employed in an ink cartridge according to a sixth embodiment of the present invention is described with reference to FIGS. 16 and 17. FIG. 16 is a cross-sectional view illustrating surroundings of a backside of the ink cartridge of the sixth embodiment. As shown there, a supplying port member 70 either constitutes or holds an ink supplying port 54 is welded to the ink bag 53. A supplying port 54 is covered with a packing 71 depressed by a cap 72 to avoid leakage of the ink therefrom. Further, by breaking through the packing 71 with an ink-supplying pipe provided in the printer body 1, an ink flow path extended toward a printing head is connected to the ink cartridge. Further, a valve such as a ball valve, etc., may be used to avoid the leakage of ink instead of the above-described packing 71 as used in the sixth embodiment.

Further, an upwardly extended portion 70*a* is provided being extended upwardly in the supplying port member 70. In addition, a pair of rising portions 70*b* and 70*b* is provided rising from the extended portion 70*a*. Hence, when the first and second sub cases 51 and 52 are secured using the ID chip accommodating container 60, the pair of rising portions 70*b* and 70*b* of the extended member 70 (now forming a groove therebetween) fit to the pair of fixing sections 62 and 62, respectively, projecting from both the sides of the ID chip accommodating container 60 as shown in FIG. 17.

A position of the ID chip-accommodating container 60 regarding the cartridge case 50 is determined when the fixing sections 62 and 62 are secured to the first and second sub cases 51 and 52, respectively. Further, by engaging the supplying port member 70 (i.e., the pair of rising portions 70*b* and 70*b*) with the fixing sections 62 and 62 of the ID chip accommodating container, respectively, the ink supplying port 54 is also appropriately positioned regarding the cartridge case as well. With this, insertion of the ink-supplying pipe (e.g., an ink supply needle) into the ink supplying port 54 can be ensured as well. Further, with the configuration of the sixth embodiment, the ribs or the like to be used in positioning the ink supplying port can be omitted from the ink cartridge case.

Figures 18A, 18B, 18C, 18D:
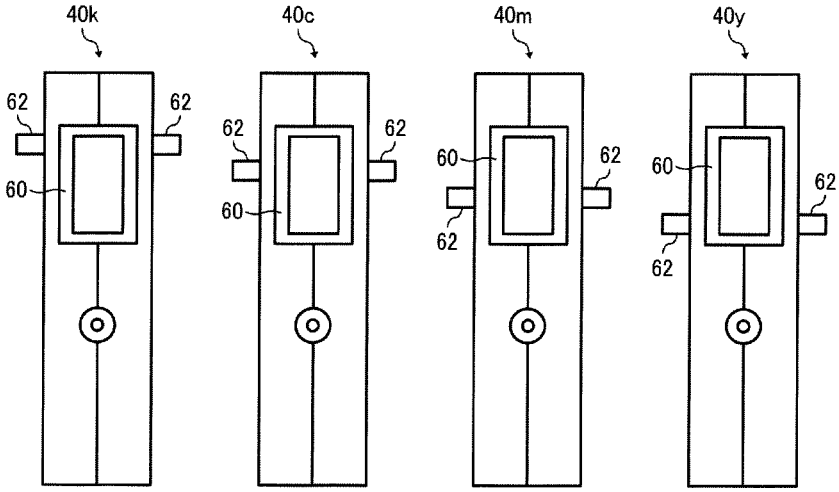
FIGS. 18A, 18B, 18C, and 18D are front views collectively illustrating a set of ink cartridges each having a color incompatibility configuration according to one embodiment of the present invention.

Now, incompatibility of the ink cartridge is described with reference to FIGS. 18A to 19. FIG. 1 shows a color image forming apparatus of an inkjet printer using multiple color ink. When a color ink cartridge of each color is inserted into the cartridge loading section 4, it needs to be set at an appropriate position. Specifically, if a wrong color ink cartridge is set, a desired image may not be obtained due to color blending. Further, the cartridge loading section 4 or the color ink cartridge itself is may be damaged when a wrong ink cartridge used in the other model is set thereto. Because of these risks, an ink cartridge preferably includes a prescribed configuration assuring the ink cartridge of incompatibilities with another color or mod 40

FIGS. 18A to 18D are front views of the ink cartridges (similar to the ink cartridges 40 of the first embodiment shown in FIG. 13) additionally having an ink color incompatible configuration. As shown in FIG. 2, four ink cartridges 40*k*, 40*c*, 40*m*, and 40*y* store black, cyan, magenta, and yellow color ink from left-to-right, respectively. Each of fixing sections 62 and 62 provided in the ID chip-accommodating container 60 of the ink cartridge 50 for each color is located at a different position (e.g., a vertically different position) from each other. Further, grooves are formed in the cartridge loading section 4 of the printer body 1 at prescribed positions corresponding to those of the fixing sections 62 and 62 protruding from both sides of the cartridge case of the ink cartridge of each of the colors 40*k*, 40*c*, 40*m*, and 40*y*. Therefore, the fixing sections 62 and 62 may not fit into the groove of the printer body 1 (i.e., the loading section 4) when a color ink cartridge 40 is set to a wrong cartridge loading section 4, thereby capable of preventing from setting the wrong color cartridge thereto. By contrast, when a color ink cartridge 40 is set to a correct cartridge loading section 4, because the fixing sections 62 and 62 can enter the groove of the printer body 1 (i.e., the loading section 4), the color ink cartridge 40 can be successfully loaded. Thus, the incompatibility of ink color of the color ink cartridge 40 can be ensured.

Although color incompatibility is described heretofore, incompatibility of the model can be obtained by substantially the same configuration as well. Further, the incompatible configuration with the pair of fixing sections 62 and 62 is not based only on a prescribed vertical position of the cartridge case 50, but also a position in a back and forth direction of the cartridge case 50. Although the fixing sections 62 and 62 are positioned at substantially the same height on both sides of the cartridge case 50 in one of the cartridge cases 50 in the illustrated example, these can be disposed on the right and left sides of the cartridge case 50 at different positions from the other. Further, the incompatible configuration can employ a combination of vertically and longitudinally different positions of the cartridge case 50 as well. With these devices, an ink cartridge 10 can be provided with color and model incompatibilities at the same time.

Although, the incompatible configuration is described in FIG. 18 based on the ink cartridge 40 shown in FIG. 13 (i.e., the second embodiment), similar incompatible configuration can be employed based on an ink cartridge with the ID chip-accommodating container 60B as described with reference to FIG. 15.

Figure 19:
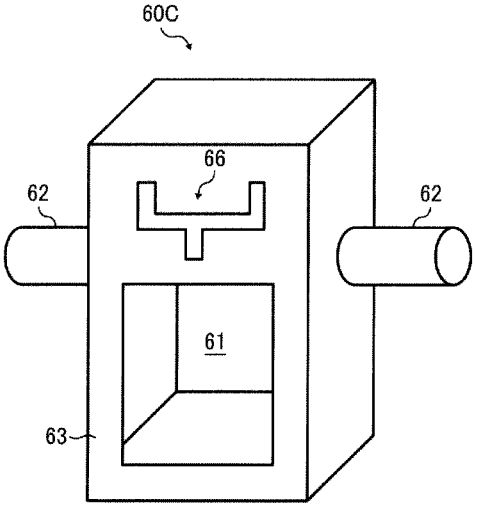
FIG. 19 is a perspective view illustrating another exemplary cartridge having a different incompatible configuration according to one embodiment of the present invention.
Figure 20:
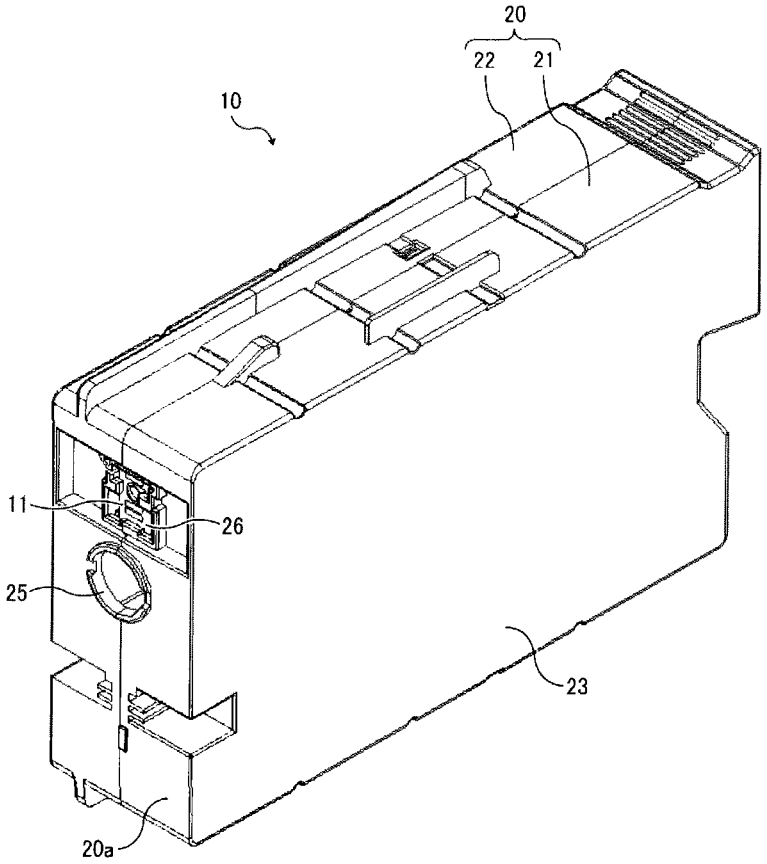
FIG. 20 is a perspective view illustrating an ink cartridge 10 according to yet another embodiment of the present invention.
Figure 21:
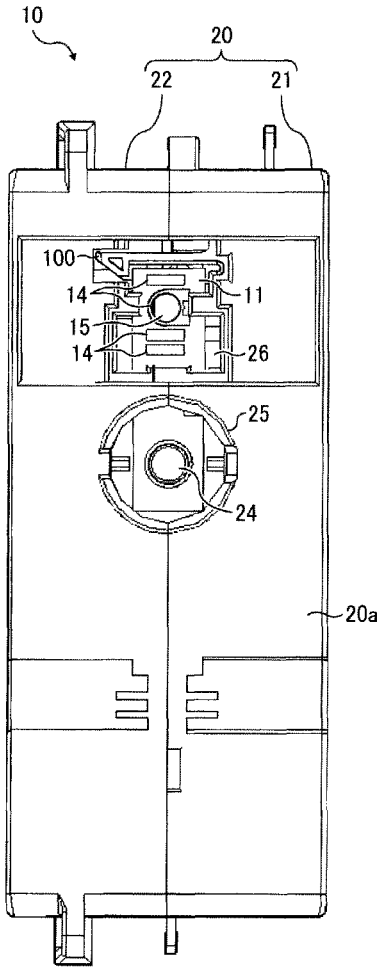
FIG. 21 is a front view illustrating the ink cartridge 10 having an ID chip 11 according to yet another embodiment of the present invention.

FIG. 19 is a perspective view illustrating a chip-accommodating container employing another incompatible configuration. The basic configuration of the ID chip-accommodating container 60C shown in the drawing is substantially the same as the ID chip-accommodating container 60 as described with reference to FIG. 14 except that an incompatible configuration 66 is provided on an upper section of the exterior wall 63. This incompatible configuration 66 may be established, for example, by a hole or a groove formed in the wall surface of the exterior wall 63. Specifically, the hole or the groove of each of the color ink cartridges 50 has a different shape from the other as the incompatible configuration 66. When the ink cartridge 10 includes the ID chip-accommodating container 60C with such an incompatible configuration 66, a prescribed convex fitting rib is correspondingly provided in the cartridge loading section 4 of the printer body 1 with a shape matching with the hole or groove of the incompatible configuration 66. Accordingly, when a wrong color cartridge is tried to load, the wrong color cartridge may not be successfully loaded, because the incompatible configuration 66 of the ID chip holder 60C does not match with the shape of the convex rib established in the loading section 4. Hence, the incompatibility can be ensured again. Further, the model incompatibility can be also established by the similar configuration as well. Furthermore, a configuration capable of providing ink color and model incompatibilities can be established at the same time again.

Figure 22:
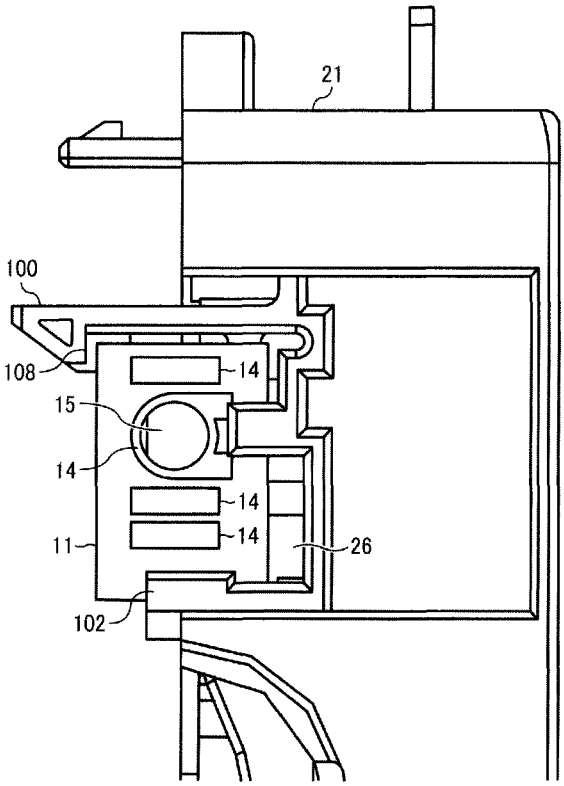
FIG. 22 is a front and partially enlarged view illustrating the ink cartridge 10 with a chip holder 26*a* according to yet another embodiment of the present invention.
Figure 23:
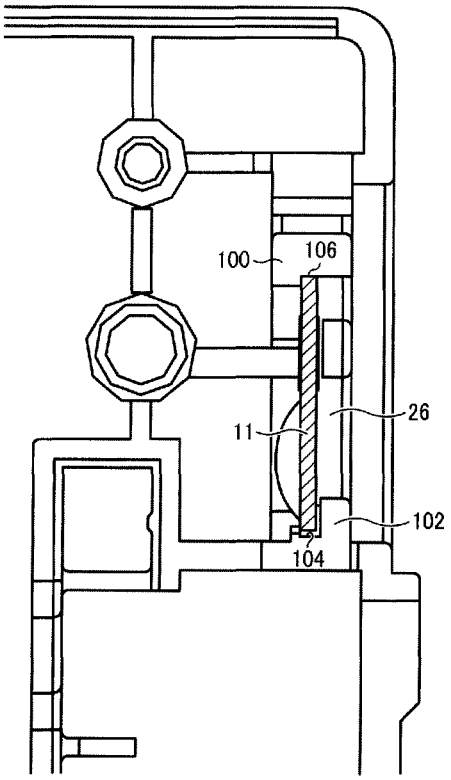
FIG. 23 is an enlarged cross-sectional view illustrating the chip holder 26*a* of the ink cartridge 10 according to yet another embodiment of the present invention.
Figure 24:
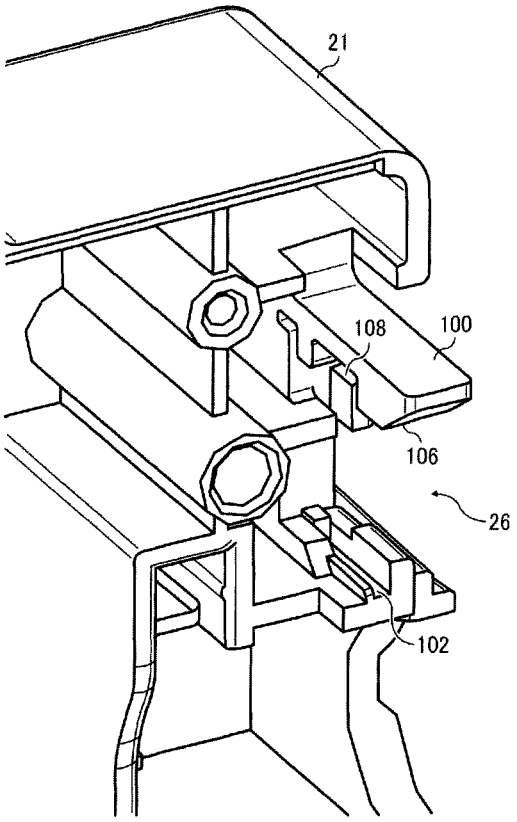
FIG. 24 is a perspective view of a chip holder 26*a* according to yet another embodiment of the present invention.

Now, yet another exemplary ink cartridge 10 according to a seventh embodiment of the present invention is described with reference to FIGS. 20 to 24, wherein like reference numerals designate identical or corresponding parts throughout the several views thereof. A basic configuration of an ink cartridge 10 of the seventh embodiment is the same with that as described with reference to FIGS. 2 and 6 to 8 except that a cartridge sub case 21 has a nail 100 and is capable of holding the ID chip 11 alone as different from the configuration of the various embodiments as shown in FIGS. 6 to 8. (Here, the cartridge case 20 as a whole includes a chip holder 26 that secures the ID chip 11 thereto having a configuration similar to that as described with reference to FIG. 7. Specifically, the chip holder 26 has a claw state snap-fit 100 placed above the chip holder 26 and a groove 102 placed below the chip holder 26.) Specifically, the cartridge case 20 of the ink cartridge 10 of this embodiment is composed of two bodies of sub cases 21 and 22 again. More specifically, as shown there, only the cartridge sub case 21 includes a chip holder 26*a* having multiple groves 104 and 106 and a nail (i.e., a snap fitting) to keep the ID chip 11 within the sub case 21 to prevent it from dropping out therefrom. That is, the nail 100 and the groove 102 collectively restricts a range of movement of the ID chip 11 in a prescribed direction (i.e., a direction in which the ink cartridge 10 is installed) within the sub case 21. Since the chip holder 26*a* includes the claw 100, the sub case 21 can hold the ID chip 11 alone while preventing dropping out of the ID chip 11 from the sub case 21 while allowing the ID chip 11 to freely move within the chip holder 26. More specifically, as shown in FIG. 22, the nail 100 includes a hook-shaped projection 108 downwardly protruding to hook and hold the ID chip 11 within the case 21 not to render the ID chip 11 to drop out therefrom. Hence, the sub case 21 can hold the ID chip 11 even before it is combined with the case 20 while preventing the ID chip 11 from dropping out therefrom.

Further, the configuration of the ink cartridge and the IC chip can be appropriately modified within a scope of the present invention. Further, the image forming apparatus can be a serial-type or line-type image forming apparatus as well.

Further, the number of colors and ink cartridges, etc., used in the image forming apparatus are chosen as convenient. Further, beside the above-described color image forming apparatus, the various embodiments of the present invention can be applied to a monochrome image forming apparatus. Further, as the image forming apparatus, any system, such as a copier, a facsimile machine, a MFP (multi-functional printer) with multiple functions, etc., can be employed beside the above-described printer.

As described heretofore, according to one aspect of the present invention, manufacturing labor and the number of parts, and accordingly the manufacturing cost as well can be reduced. Because, a liquid cartridge detachably attached to an image forming apparatus to supply liquid thereto includes a cartridge case composed of first and second sub cases. At least one of the first and second sub cases includes an open space to accommodate an information storage device in the open space. The first and second sub cases are combined to close the open space and hold the information storage device so as to prevent removal of the information storage device accommodated in the open space therefrom.

According to another aspect of the present invention, manufacturing labor and the number of parts and accordingly the manufacturing cost as well can be more effectively reduced. Because, the ID chip is held in the ink cartridge by the cartridge case itself without using a cover as different parts to prevent it from dropping out from the cartridge. Because, a liquid cartridge detachably attached to an image forming apparatus to supply liquid thereto includes a cartridge case composed of first and second sub cases and an information storage device holder provided in the cartridge case to hold an information storage device. At least one of the first and second sub cases includes an open space to accommodate the information storage device therein. The open space is closed to prevent removal of the information storage device inserted thereinto when the first and second sub cases are combined.

According to yet another aspect of the present invention, manufacturing labor and the number of parts, and accordingly the manufacturing cost as well can be more effectively reduced. Because, at least one of first and second sub cases includes a cutout communicating with the open space to allow connection of an external terminal to a terminal provided in the information storage device held by the information storage device holder when the first and second sub cases are combined.

According to yet another aspect of the present invention, manufacturing labor and the number of parts, and accordingly the manufacturing cost as well can be more effectively reduced. Because, a liquid supply inlet member is provided to either establish or hold a liquid supply inlet and supply liquid from the cartridge to image forming apparatus. The liquid supply inlet member includes a first fitted section into which a first positioning member provided in the image formation apparatus is fitted when the liquid cartridge is attached to the image formation apparatus. The information storage device includes a second fitted section into which a second positioning member provided in the image formation apparatus is fitted when the liquid cartridge is attached to the image formation apparatus.

According to yet another aspect of the present invention, manufacturing labor and the number of parts, and accordingly the manufacturing cost as well can be more effectively reduced. Because, the cartridge case includes a third fitted sec into which a third positioning member provided in the image formation apparatus is fitted when the cartridge is attached to the image formation apparatus.

According to yet another aspect of the present invention, the ink cartridge is easily assembled while reducing manufacturing labor and the number of parts, and accordingly the manufacturing cost as well. Because, spaces in the first and the second cases (collectively) serving as an ID chip holder 26 are symmetrically shaped, and the ID chip can be selectively inserted into the both spaces of the first and the second cases. Specifically, a pair of symmetrical open spaces is formed in the first and second sub cases of the ink cartridge case.

According to yet another aspect of the present invention, a securing member such as a screw, etc., can be omitted, thereby capable of reducing manufacturing labor and the number of parts, and accordingly the manufacturing cost as well. Because, the ID chip accommodating container holding the ID chip secures the multiple members (i.e., the first and second sub cases 51 and 52) even when the ink cartridge with the cartridge case composed of more than one member (e.g., the first and second sub cases 51 and 52 in the illustrated example).

According to yet another aspect of the present invention, the ink cartridge can precisely hold the ID chip at low-cost while reducing manufacturing labor and the number of parts. Because, operation of securing the multiple members can be eased while reducing the manufacturing labor. Specifically, a liquid cartridge detachably attached to an image forming apparatus to supply liquid thereto includes a cartridge case composed of first and second sub cases and an information storage device holder attached to the cartridge case to hold an information storage device. The information storage device holder fixes the first and second sub cases.

According to yet another aspect of the present invention, manufacturing labor and the number of parts, and accordingly the manufacturing cost as well can be more effectively reduced. Because, the information storage device holder is either glued or welded to the first and second sub cases.

According to yet another aspect of the present invention, manufacturing labor and the number of parts, and accordingly the manufacturing cost as well can be more effectively reduced. Because, the information storage device holder is secured to the first and second sub cases using a detachable fastener.

According to yet another aspect of the present invention, manufacturing labor and the number of parts, and accordingly the manufacturing cost as well can be more effectively reduced. Because, a liquid supply inlet member is provided to either establish or hold a liquid supply inlet to supply liquid from the liquid cartridge to an image forming apparatus. The liquid supply inlet member includes a fitting section to fit to the information storage device holder.

According to yet another aspect of the present invention, manufacturing labor and the number of parts, and accordingly the manufacturing cost as well can be more effectively reduced. Because, a prescribed incompatible configuration is provided to provide incompatibility with another liquid cartridge storing liquid of different color or another model of a machine.

According to yet another aspect of the present invention, manufacturing labor and the number of parts, and accordingly the manufacturing cost as well can be more effectively reduced. Because, the ID chip is held by the cartridge case by itself in a liquid cartridge without using a cover as separate parts therefrom. Specifically, the liquid cartridge includes a cartridge case composed of first and second sub cases and an information storage device holder provided in the cartridge case to hold an information storage device. At least one of the first and second sub cases includes an open space to accommodate the information storage device therein. The open space is closed to prevent removal of the information storage device inserted thereinto when the first and second sub cases are combined.

According to yet another aspect of the present invention, manufacturing labor and the number of parts, and accordingly the manufacturing cost as well can be more effectively reduced. Because, the first and second sub cases constituting a cartridge case are fixed by using an information storage device holder in the liquid cartridge, and accordingly a securing member such as a screw, etc., can be omitted.

According to yet another aspect of the present invention, securing operation becomes eased while reducing the number of parts, and accordingly the manufacturing cost. Because, a liquid cartridge detachably attached to an image forming apparatus to supply liquid thereto includes a cartridge case composed of first and second sub cases and an information storage device holder attached to the cartridge case to hold an information storage device. The information storage device holder fixes the first and second sub cases.

Numerous additional modifications and variations of the present invention are possible in light of the above teachings.

It is therefore to be understood that within the scope of the appended claims, the present invention may be executed otherwise than as specifically described herein. For example, the order of steps for forming the image forming apparatus is not limited to the above-described various embodiments and can be appropriately changed.

What is claimed is:

1. A liquid cartridge detachably attached to an image forming apparatus to supply liquid thereto, the liquid cartridge comprising:

a cartridge case composed of first and second sub cases, at least one of the first and second sub cases including an open space to accommodate an information storage device therein, wherein the first and second sub cases are combined to close the open space and hold the information storage device so as to prevent removal of the information storage device accommodated in the open space.

2. The liquid cartridge as claimed in claim 1, wherein the at least one of first and second sub cases includes a cutout communicating with the open space, wherein the cutout is configured to allow connection of an external terminal to a terminal provided in the information storage device held by the information storage device holder when the first and second sub cases are combined.

3. The liquid cartridge as claimed in claim 1, wherein a pair of symmetrical open spaces is formed in the first and second sub cases.

4. The liquid cartridge as claimed in claim 1, further comprising a liquid supply inlet member either to establish or hold a liquid supply inlet to supply liquid from the cartridge to image forming apparatus, the liquid supply inlet member including a first fitted section into which a first positioning member provided in the image formation apparatus is fitted when the liquid cartridge is attached to the image formation apparatus, wherein the information storage device includes a second fitted section into which a second positioning member provided in the image formation apparatus is fitted when the liquid cartridge is attached to the image formation apparatus.

5. The liquid cartridge as claimed in claim 4, wherein the cartridge case includes a third fitted section into which a third positioning member provided in the image formation apparatus is fitted when the cartridge is attached to the image formation apparatus.

6. A liquid cartridge detachably attached to an image forming apparatus to supply liquid thereto, the liquid cartridge comprising:

a cartridge case composed of first and second sub cases; and an information storage device holder attached to the cartridge case to hold an information storage device, wherein the information storage device holder fixes the first and second sub cases.

7. The liquid cartridge as claimed in claim 6, wherein the information storage device holder is either glued or welded to the first and second sub cases.

8. The liquid cartridge as claimed in claim 6, wherein the information storage device holder is secured to the first and second sub cases using a detachable fastener.

9. The liquid cartridge as claimed in claim 6, further comprising a liquid supply inlet member either to establish or hold a liquid supply inlet to supply liquid from the liquid cartridge to an image forming apparatus, wherein the liquid supply inlet member includes a fitting section to fit to the information storage device holder.

10. The liquid cartridge as claimed in claim 6, having a prescribed incompatible configuration providing incompatibility with another liquid cartridge storing liquid of a different color or another model of a machine.

11. The liquid cartridge as claimed in claim 6, wherein the information storage device holder includes a hook.

12. An image forming apparatus comprising:

a printing system to print an image on a sheet using liquid; and a liquid cartridge detachably attached to the image forming apparatus to store the liquid, the liquid cartridge including:

a cartridge case composed of first and second sub cases; and an information storage device holder provided in the cartridge case to hold an information storage device, at least one of the first and second sub cases including an open space to accommodate the information storage device therein, wherein the open space is closed to prevent removal of the information storage device inserted thereinto when the first and second sub cases are combined.

13. The image forming apparatus as claimed in claim 12, wherein the at least one of first and second sub cases includes a cutout communicating with the open space, wherein the cutout is configured to allow connection of an external terminal to a terminal provided in the information storage device held by the information storage device holder when the first and second sub cases are combined.

14. The image forming apparatus as claimed in claim 12 wherein a pair of symmetrical open spaces is formed in the first and second sub cases.

15. The image forming apparatus as claimed in claim 14, wherein the cartridge case includes a third fitted section into which a third positioning member provided in the image formation apparatus is fitted when the cartridge is attached to the image formation apparatus.

16. The image forming apparatus as claimed in claim 12, further comprising a liquid supply inlet member either to establish or hold a liquid supply inlet to supply liquid from the cartridge to image forming apparatus, the liquid supply inlet member including a first fitted section into which a first positioning member provided in the image formation apparatus is fitted when the liquid cartridge is attached to the image formation apparatus, wherein the information storage device includes a second fitted section into which a second positioning member provided in the image formation apparatus is fitted when the liquid cartridge is attached to the image formation apparatus.

17. The image forming apparatus as claimed in claim 12 wherein the information storage device holder is attached to the cartridge case to hold the information storage device and the information storage device holder fixes the first and second sub cases.

18. The image forming apparatus as claimed in claim 17, wherein the information storage device holder is either glued or welded to the first and second sub cases.

19. The image forming apparatus as claimed in claim 17, wherein the information storage device holder is secured to the first and second sub cases using a detachable fastener.

20. The image forming apparatus as claimed in claim 17, further comprising a liquid supply inlet member either to establish or hold a liquid supply inlet to supply liquid from the liquid cartridge to an image forming apparatus, wherein the liquid supply inlet member includes a fitting section to fit to the information storage device holder.

* * * * *